US009768486B2

(12) United States Patent
Squillacioti

(10) Patent No.: US 9,768,486 B2
(45) Date of Patent: Sep. 19, 2017

(54) MODE SUPPRESSION RESONATOR

(71) Applicant: Lockheed Martin Corporation, Bethesda, MD (US)

(72) Inventor: Ronald L. Squillacioti, Chelmsford, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 181 days.

(21) Appl. No.: 14/630,948

(22) Filed: Feb. 25, 2015

(65) Prior Publication Data

US 2015/0171502 A1 Jun. 18, 2015

Related U.S. Application Data

(63) Continuation of application No. 12/737,735, filed as application No. PCT/US2009/053341 on Aug. 11, 2009, now Pat. No. 9,000,868.

(Continued)

(51) Int. Cl.
*H01P 1/16* (2006.01)
*H01P 7/06* (2006.01)

(52) U.S. Cl.
CPC ..... *H01P 7/06* (2013.01)

(58) Field of Classification Search
CPC ..... H01P 7/06

(Continued)

(56) References Cited

U.S. PATENT DOCUMENTS 2,496,772 A 2/1950 Bradley
2,593,155 A 4/1952 Kinzer (Continued)

FOREIGN PATENT DOCUMENTS

EP 0899808 A2 3/1999

OTHER PUBLICATIONS

Thal, Herbert L., "Cylindrical TE011/TM111 Mode Control by Cavity Shaping," IEEE Transactions on Microwave Thoery and Techniques, vol. 27, Issue 12, Dec. 1979, IEEE, pp. 982-986.

(Continued)

*Primary Examiner* — Robert Pascal
*Assistant Examiner* — Kimberly Glenn
(74) *Attorney, Agent, or Firm* — Withrow & Terranova, PLLC

(57) ABSTRACT

The present disclosed technique pertains to high Q mode resonators, and, more particularly, to a technique for separating a high Q mode from masking low Q modes. In a first aspect, it includes a high Q mode resonator, comprising: a housing defining a clover-shaped resonating cavity; a dielectric material filling the cavity; an input to the cavity; and an output from the cavity. In a second aspect, it includes a high Q mode resonator, comprising: a housing defining a clover-shaped resonating cavity, the cavity comprising four intersecting right angle, cylindrical chambers; a fluid dielectric material filling the cavity; an input to the cavity; and an output from the cavity. In a third aspect, it includes a method, comprising: introducing a signal to a resonating cavity; resonating the signal within a chamber, the resonating cavity shifting the resonance of the low Q mode higher in frequency than it shifts the high Q mode; and permitting egress of the signal from the resonating cavity. In a fourth aspect, it includes a method for use in designing a high Q mode resonator, comprising: calculating the dimensions of the simple cylindrical cavity for the frequency desired for the high Q mode; and decreasing the outer radius of the simple cylindrical cavity while holding the sum of the inner and outer radius equal to the initial simple cylindrical radius.

18 Claims, 4 Drawing Sheets

Related U.S. Application Data

(60) Provisional application No. 61/088,023, filed on Aug. 12, 2008.

(58) Field of Classification Search
USPC ..... 333/227, 228
See application file for complete search history.

(56) References Cited

U.S. PATENT DOCUMENTS

| | | | | | |
|---|---|---|---|---|---|
| 3,375,475 | A | * | 3/1968 | Harris | H01J 23/24 315/3.5 |
| 3,594,605 | A | * | 7/1971 | Blinn | H01J 23/30 315/3.5 |
| 3,628,084 | A | * | 12/1971 | Butwell | H01J 23/24 315/3.5 |
| 4,291,281 | A | | 9/1981 | Pinard et al. | |
| 4,314,204 | A | | 2/1982 | Biehl et al. | |
| 4,340,870 | A | | 7/1982 | Dydyk | |
| 4,378,532 | A | | 3/1983 | Burgoon | |
| 4,519,708 | A | | 5/1985 | Perlmutter et al. | |
| 4,627,732 | A | | 12/1986 | Braun et al. | |
| 4,673,894 | A | | 6/1987 | Rogers | |
| 4,692,723 | A | | 9/1987 | Fiedziuszko et al. | |
| 4,963,841 | A | | 10/1990 | Sparagna | |
| 5,017,881 | A | | 5/1991 | Palmer | |
| 5,471,180 | A | | 11/1995 | Brommer et al. | |
| 5,614,877 | A | | 3/1997 | Raghavan et al. | |
| 5,796,319 | A | | 8/1998 | Kich | |
| 6,094,113 | A | | 7/2000 | Wenzel et al. | |
| 6,239,673 | B1 | | 5/2001 | Wenzel et al. | |
| 6,486,754 | B1 | | 11/2002 | Hidaka et al. | |
| 6,650,685 | B2 | | 11/2003 | Halmos et al. | |
| 9,000,868 | B2 | | 4/2015 | Squillacioti | |
| 2005/0068127 | A1 | | 3/2005 | Ham et al. | |
| 2007/0103258 | A1 | | 5/2007 | Weinstein et al. | |
| 2011/0133864 | A1 | | 6/2011 | Squillacioti | |

OTHER PUBLICATIONS

International Search Report and Written Opinion for PCT/US2009/053341, mailed Feb. 11, 2009, 12 pages.

International Preliminary Report on Patentability for PCT/US2009/053341, mailed Feb. 15, 2011, 8 pages.

Non-Final Office Action for U.S. Appl. No. 12/737,735, mailed Oct. 25, 2013, 5 pages.

Final Office Action for U.S. Appl. No. 12/737,735, mailed May 30, 2014, 6 pages.

Notice of Allowance and Examiner's Amendment for U.S. Appl. No. 12/737,735, mailed Aug. 12, 2014, 7 pages.

* cited by examiner

MODE SUPPRESSION RESONATOR

This application is a continuation of co-pending U.S. patent application Ser. No. 12/737,735, filed Feb. 11, 2011, entitled MODE SUPPRESSION RESONATOR, which is a 35 U.S.C. §371 national phase filing of International Application No. PCT/US09/53341, filed Aug. 11, 2009, entitled MODE SUPPRESSION RESONATOR, which claims the benefit of U.S. Provisional Patent Application No. 61/088,023, filed Aug. 12, 2008, entitled MODE SUPPRESSION RESONATOR, the disclosures of which are hereby incorporated herein by reference in their entireties.

BACKGROUND OF THE INVENTION

1. Field of the Invention

The present disclosed technique pertains to high Q mode resonators, and, more particularly, to a technique for separating a high Q mode from masking low Q modes.

2. Description of the Related Art

This section of this document is intended to introduce various aspects of the art that may be related to various aspects of the present invention described and/or claimed below. This section provides background information to facilitate a better understanding of the various aspects of the present invention. As the section's title implies, this is a discussion of related art. That such art is related in no way implies that it is also prior art. The related art may or may not be prior art. It should therefore be understood that the statements in this section of this document are to be read in this light, and not as admissions of prior art. In a high Q mode of resonation, the high Q mode is masked by a number of lower Q modes at the same frequency of resonance. It is desirable to separate the frequency of the high Q resonance from the lower Q resonances. Current approaches insert a probe into the resonator to disturb the lower Q modes and separate them from the high Q mode. However, this approach yields several undesirable consequences. For example, this approach disturbs the fields of the high Q mode thereby reducing its Q. The present invention is directed to resolving, or at least reducing, one or all of the problems mentioned above.

SUMMARY OF THE INVENTION

In a first aspect, the presently disclosed techniques includes a high Q mode resonator, comprising: a housing defining a clover-shaped resonating cavity; a dielectric material filling the cavity; an input to the cavity; and an output from the cavity.

In a second aspect, it includes a high Q mode resonator, comprising: a housing defining a clover-shaped resonating cavity, the cavity comprising four intersecting right angle, cylindrical chambers; a fluid dielectric material filling the cavity; an input to the cavity; and an output from the cavity.

In a third aspect, it includes a method, comprising: introducing a signal to a resonating cavity; resonating the signal within a chamber, the resonating cavity shifting the resonance of the low Q mode higher in frequency than it shifts the high Q mode; and permitting egress of the signal from the resonating cavity.

In a fourth aspect, it includes a method for use in designing a high Q mode resonator, comprising: calculating the dimensions of the simple cylindrical cavity for the frequency desired for the high Q mode; and decreasing the outer radius of the simple cylindrical cavity while holding the sum of the inner and outer radius equal to the initial simple cylindrical radius.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which:

FIG. 1A-FIG. 1E depict one particular embodiment of the resonator, in which:

FIG. 1A depicts the high Q mode resonator in an assembled perspective view;

FIG. 1B and FIG. 1C illustrate the high Q mode resonator sectioned along line A-A in FIG. 1A from two different perspectives;

FIG. 1D depicts the high Q mode resonator sectioned along line B-B in FIG. 1A; and FIG. 1E depicts the high Q mode resonator in an exploded perspective view;

Figure 1A:
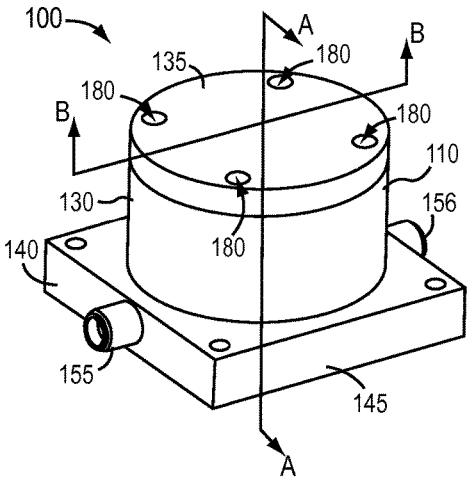

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The presently disclosed technique separates the frequency of the high Q resonance from the lower Q resonances. It changes the shape of the outside walls of the resonator to a "clover" shape as discussed further below. The shape of this resonator moves the lower Q resonances away from the high Q resonance to allow for further filtering to obtain only the high Q mode. It thereby allows the fields of the high Q mode to remain symmetric and hold its high Q parameter.

The present invention will now be described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention.

Figure 1B:
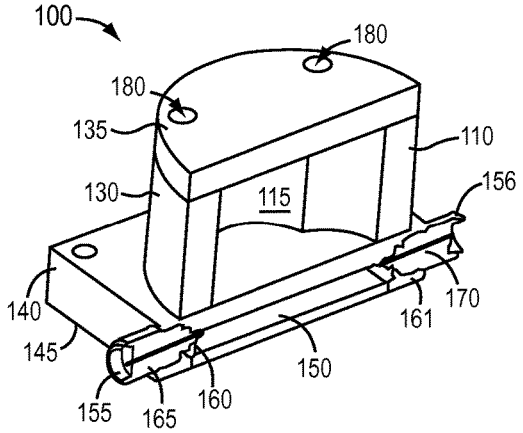
Figure 1C:
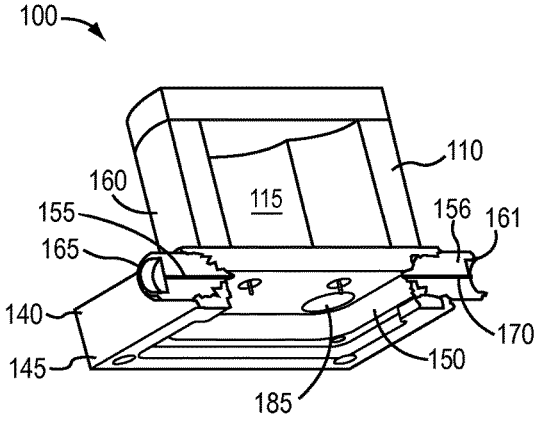
Figure 1D:
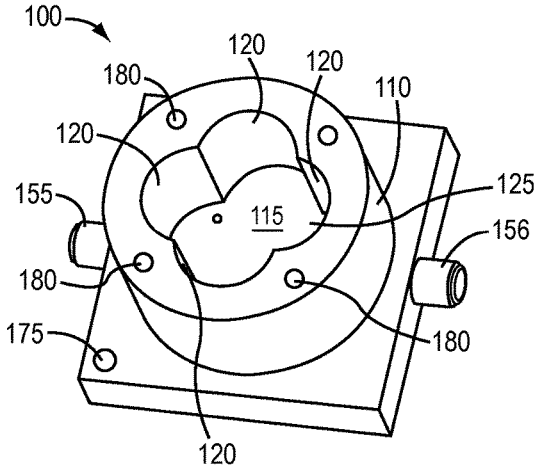
Figure 1E:
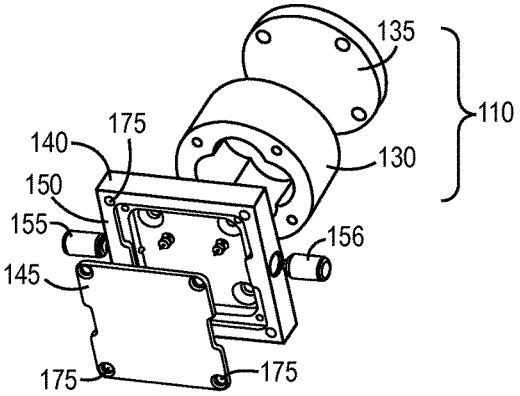

The presently disclosed technique includes a high Q mode resonator 100 such as the particular embodiment shown in FIG. 1A-FIG. 1E. FIG. 1A and FIG. 1E depict the high Q mode resonator 100 in assembled and exploded perspective views, respectively. FIG. 1B and FIG. 1C illustrate the high Q mode resonator 100 sectioned along line A-A in FIG. 1A from two different perspectives. FIG. 1D depicts the high Q mode resonator 100 sectioned along line B-B in FIG. 1A.

Referring now to FIG. 1A-FIG. 1E, and in particular to FIG. 1D, the high Q-mode resonator 100 includes a housing 110 defining a clover-shaped resonating cavity 115. The clover-shaped resonating cavity 115 of the illustrated embodiment comprises four chambers 120. However, alternative embodiments may use a different number of chambers 120, e.g., two, three, or five chambers 120, with varying effects. A dielectric material 125 fills the cavity. The high Q-mode resonator 100 also includes an input to the cavity and an output from the cavity.

In the embodiment of FIG. 1A-FIG. 1E, the housing 110 is fabricated in two parts, a body 130 and a cap 135, best shown in FIG. 1A. But this is not so in all embodiments—for example, the housing 110 can be milled as a single piece in some embodiments. The housing 110 can be fabricated from any material that would give a solid form as long as the inner surface is metal. The surface metal should be low loss like silver, copper or gold with a thickness of at less 3 skin depths (100 micro inches at Ku Band). The illustrated embodiment was constructed of solid copper, although aluminum with a silver plating and then gold plating would work well. To reduce the temperature effects due to the expansion of the copper or aluminum housing, silver/gold plated Zerodur (glass) might also be used. In general, the housing 110 should be fabricated of a metalized material.

The dielectric material 125 would normally be solid and of a low loss material. Typically used are ceramics like Barium Titanate and metal oxides like aluminum oxide (alumina, sapphire). However, in the illustrated embodiment, the dielectric material 125 is air. Thus, the dielectric material 125 may be either a fluid or a solid depending on the embodiment.

The high Q-mode resonator 100 also includes a base 140 which, in conjunction with the housing 110, defines the clover-shaped resonating cavity 115 and, in conjunction with the plate 145, a chamber 150. A pair of fittings 155, 156 mated to apertures 160, 161 in the base 140 define an ingress 165 and an egress 170 for the signal as described below. While the base 140 and plate 145 are shown as separate structures that may be joined by fasteners (not shown) through aligned bores 175 (not all indicated) in the plate 145 and the base 140, the two may be fabricated in a single piece. The base 140 furthermore includes apertures 185 through which the signal may pass between the chamber 150 and the clover-shaped resonating cavity 115.

As may be apparent from the disclosure above, the number of pieces in which the high Q-mode resonator 100 is fabricated is not material to the invention. As is best shown in FIG. 1E, the illustrated embodiment comprises the cap 135 and body 130 of the housing 110, the base 140, the fittings 155, 156, and the plate 145. The base 140 and plate 145 are joined as described above. The cap 135, body 130, and base 140 are similarly joined by fasteners (not shown) inserted into the bores 180 (not all indicated) in each of the cap 135, body 130, and base 140.

In another aspect, the presently disclosed technique also includes a method. The method comprises: introducing a signal to a resonating cavity 115; resonating the signal within a resonating cavity 115, the resonating cavity 115 shifting the resonance of the low Q mode higher in frequency than it shifts the high Q mode; and permitting egress of the signal from the resonating cavity 115. In the illustrated embodiment, the low Q mode is a TM111 mode and the high Q mode is a TE011 mode. The clover shape of the resonating cavity 115 shifts the resonance of the TM111 mode higher in frequency than it shifts the TE011 mode. Note, however, that there are a very large number of resonate modes and this seems to effect them all in some way. The presently disclosed technique is therefore not limited to separating the particular modes mentioned herein.

In still another aspect, the presently disclosed technique includes a computer-implemented method for use in designing a high Q mode resonator 100. The computer-implemented method comprises: calculating the dimensions of the simple cylindrical cavity for the frequency desired for the high Q mode; and decreasing the outer radius of the simple cylindrical cavity while holding the sum of the inner and outer radius equal to the initial simple cylindrical radius.

Figure 2:
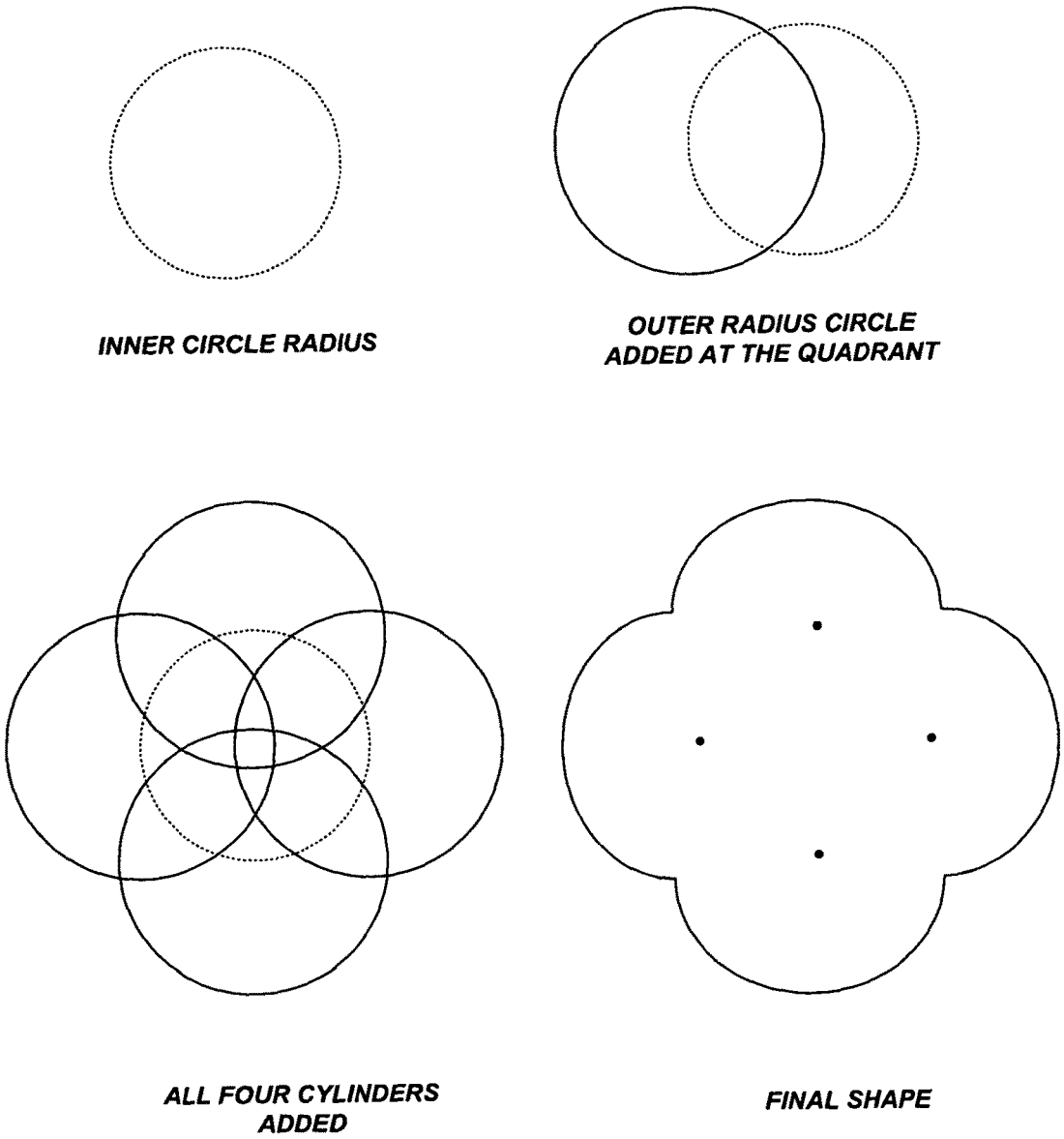
FIG. 2 illustrates some design principles for the resonating cavity.

The TE011 resonate mode of the typical right angle cylindrical resonator is a high Q mode that is masked by the lower Q, TM111 mode. The present technique separates these modes with an approach in which four right angle cylinders are separated by an inner radii circle as depicted in FIG. 2. Although this example depicts an air dielectric and four cylinders, other dielectrics and multiple cylinders may be used with similar results. Also this Ku Band frequency may be different depending on the application. The designer initially calculates the dimensions of the simple cylindrical cavity for the frequency desired for the TE011 mode. Equation 1 denotes one of the common equations for calculating the frequency:

$$F(\text{GHz}) = 11.802\frac{\sqrt{\frac{1}{K^2}+\frac{P^2D^2}{4L^2}}}{D\sqrt{E}} \tag{1}$$

where:

D=diameter of cylinder in inches

L=Length of cylinder in inches

E=dielectric constant, 1 for air

K=mode constant, 0.82 for the TE01 mode

P=# half wavelength long, TEmnp, 1 for the TE011 mode

Simple Cylindrical Dimensions for Resonate Frequency of 15.835 GHz

Diameter=1.074 inches (radius=0.537)

Length=0.700 inches

R(inner)+R(outer)=0.537

R(inner)/R(outer)=0.86

R(outer)=0.537/1.86=0.288

R(inner)=0.248

Figure 3:
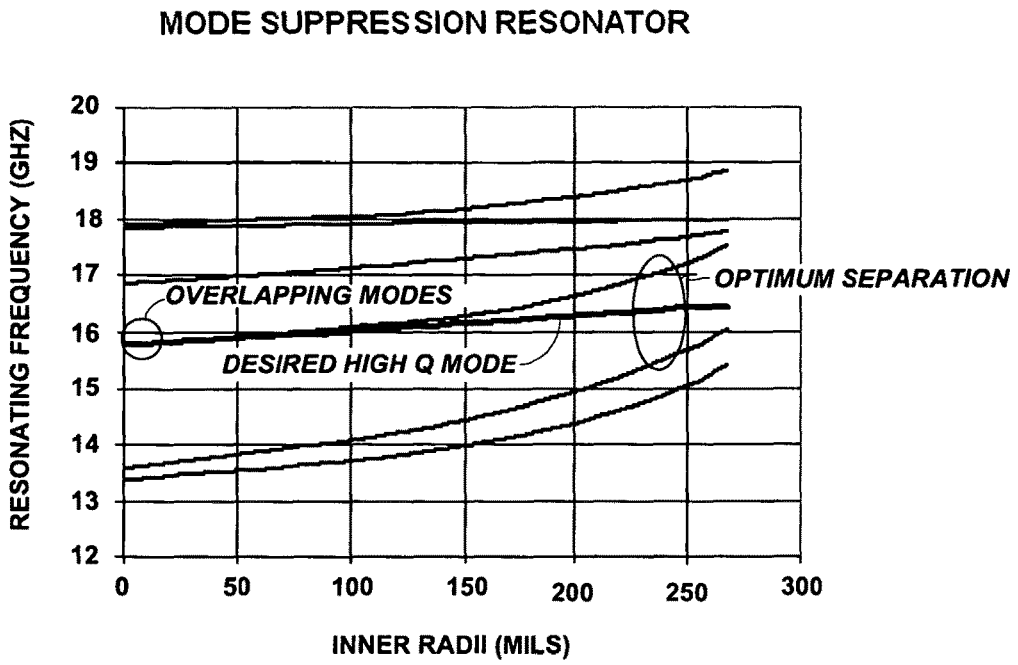
FIG. 3 graphs the relationship between the inner radius and the resonating frequency for the illustrated embodiment.

Because of the more complex structure of the Mode Suppression Resonator, EM software like CST MICROWAVE STUDIO EIGEN-MODE SOLVER is used to calculate the final resonating frequency. FIG. 3 shows the effects of the overlaying modes (i.e., the plotted curves) with increasing inner radius. The TE011 mode (i.e., the "desired high Q mode in this embodiment) is separated in frequency from the other modes. The outer radius is decreased keeping the sum of the inner and outer radius equal to the initial simple cylindrical radius. The optimum R(inner)/R(outer) ratio is at about 0.86. In this example, the inner radius is 0.248" and the outer is 0.288". This best mode is where the separation between the TE011 mode and all other modes is the greatest and the Q has not been greatly affected.

Figure 4:
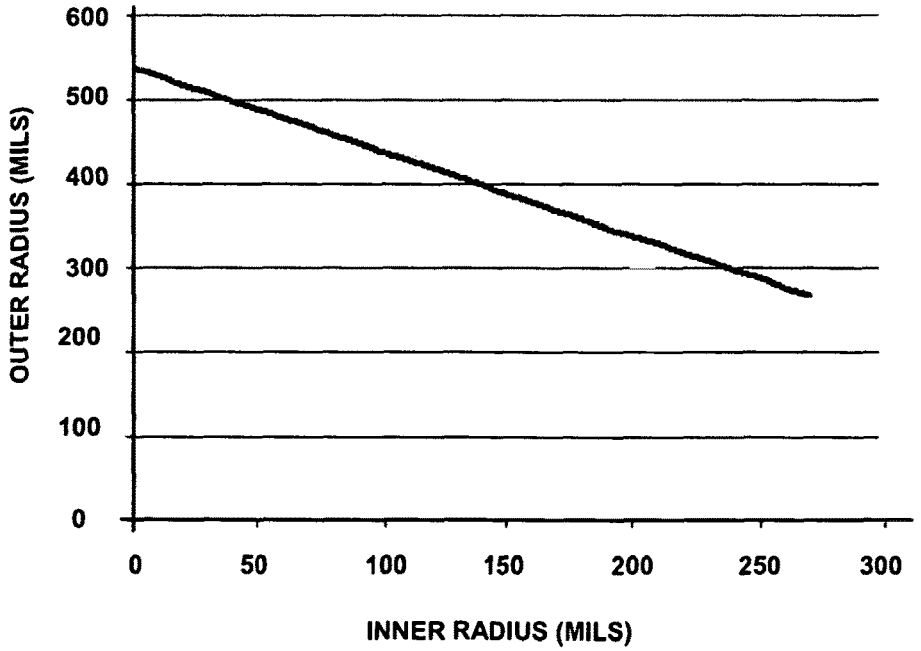
FIG. 4 graphs the ratio of the inner and outer radii.

That is, if one starts with the inner radius as zero, the outer radius is the normal radius of the right angle cylinder, i.e. 0.537". Now if the inner radius is increased to 0.100", then the outer decreases to 0.537"−0.100"=0.437". Increase the inner radius to 0.200" then the outer radius decrease to 0.537−0.200=0.337. This is keeping the sum of the inner and outer radius to 0.537". This keeps the center frequency of resonance from shifting too much as illustrated in FIG. 4.

Figure 5:
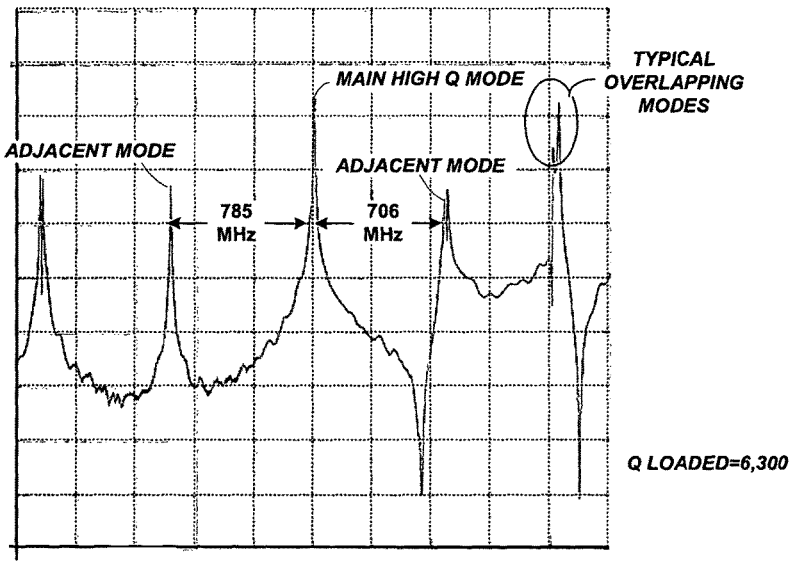
FIG. 5 graphs data from one particular embodiment to illustrate the separation of adjacent modes from the main high Q mode.

FIG. 5 graphs data from one particular embodiment to illustrate the separation of adjacent modes from the main high Q mode.

Figure 6:
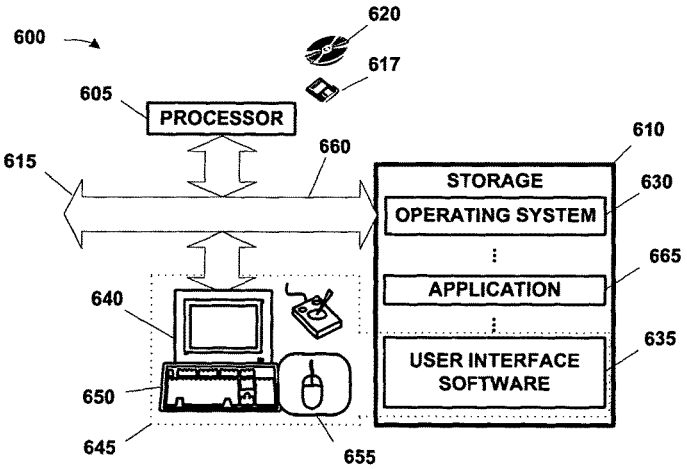
FIG. 6 shows selected portions of the hardware and software architecture of a computing apparatus such as may be employed in some aspects of the present invention.

In one aspect, the present invention is a software implemented method and computing apparatus for use in designing a high Q mode resonator 100 as discussed above. FIG. 6 shows selected portions of the hardware and software architecture of a computing apparatus 600 such as may be employed in some aspects of the present invention. The computing apparatus 600 includes a processor 605 communicating with storage 610 over a bus system 615. The storage 610 may include a hard disk and/or random access memory ("RAM") and/or removable storage such as a floppy magnetic disk 617 and an optical disk 620.

The storage 610 is also encoded with an operating system 630, user interface software 635, and an application 665. The user interface software 635, in conjunction with a display 640, implements a user interface 645. The user interface 645 may include peripheral I/O devices such as a keypad or keyboard 650, a mouse 655, or a joystick 660. The processor 605 runs under the control of the operating system 630, which may be practically any operating system known to the art. The application 665 is invoked by the operating system 630 upon power up, reset, or both, depending on the implementation of the operating system 630. The application 665, when invoked, performs the method of the presently disclosed technique. The user may invoke the application in conventional fashion through the user interface 645.

Some portions of the detailed descriptions herein are consequently presented in terms of a software implemented process involving symbolic representations of operations on data bits within a memory in a computing system or a computing device. These descriptions and representations are the means used by those in the art to most effectively convey the substance of their work to others skilled in the art. The process and operation require physical manipulations of physical quantities. Usually, though not necessarily, these quantities take the form of electrical, magnetic, or optical signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated or otherwise as may be apparent, throughout the present disclosure, these descriptions refer to the action and processes of an electronic device, that manipulates and transforms data represented as physical (electronic, magnetic, or optical) quantities within some electronic device's storage into other data similarly represented as physical quantities within the storage, or in transmission or display devices. Exemplary of the terms denoting such a description are, without limitation, the terms "processing," "computing," "calculating," "determining," "displaying," and the like.

Note also that the software implemented aspects of the invention are typically encoded on some form of program storage medium or implemented over some type of transmission medium. The program storage medium may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The invention is not limited by these aspects of any given implementation.

Some embodiments of this aspect may be implemented on a computing system comprising more than one computing apparatus.

The following document is hereby incorporated by reference for all purposes as if set forth verbatim herein:

U.S. Provisional Application 61/088,023, entitled, "Mode Suppression Resonator", filed Aug. 12, 2008, in the name of the inventor Ronald L. Squillacioti.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A resonator comprising:

a base having a top surface;

a cap having a bottom surface; and a housing comprising an interior side wall surface that extends from the bottom surface to the top surface to form a single resonating cavity having a plurality of congruent chambers, wherein:

each chamber is formed by a corresponding side wall surface segment of a plurality of side wall surface segments, each side wall surface segment having two edges that extend from the bottom surface to the top surface, and each side wall surface segment having a concave continually curving shape; and each side wall surface segment being congruent with each other side wall surface segment and terminating at a common intersection point with an adjacent side wall surface segment on each of the two edges of the respective side wall surface segment.

2. The resonator of claim 1, wherein the base further comprises a signal ingress port configured to pass a signal into the resonating cavity, and a signal egress port configured to pass a signal out of the resonating cavity.

3. The resonator of claim 1, wherein the resonating cavity is configured to shift a resonant frequency of a low Q mode comprising a TM111 mode higher in frequency than the resonating cavity shifts a resonant frequency of a high Q mode comprising a TE011 mode.

4. The resonator of claim 1, wherein each of the two edges is located closer to a center of the resonating cavity than any other point on any of the plurality of side wall surface segments.

5. The resonator of claim 1, wherein the base forms a first plurality of openings, a side wall of the housing forms a second plurality of openings, and the cap forms a third plurality of openings, and the base, the side wall, and the housing are configured to be aligned such that the first plurality of openings, the second plurality of openings, and the third plurality of openings form a plurality of througholes that extend through the base, the housing, and the cap.

6. The resonator of claim 1, wherein the resonator comprises four chambers.

7. The resonator of claim 1, wherein the resonator comprises three chambers.

8. The resonator of claim 1, wherein the resonator comprises five chambers.

9. The resonator of claim 1, wherein each side wall surface segment is cylindrical.

10. A method for generating a resonating signal, comprising:

introducing a signal into a single resonating cavity having a plurality of congruent chambers formed from a housing comprising an interior side wall surface that extends from a bottom surface of a cap to a top surface of a base, wherein:

each chamber is formed via a corresponding side wall surface segment of a plurality of side wall surface segments, each side wall surface segment having two edges that extend from the bottom surface to the top surface, and each side wall surface segment having a concave continually curving shape; and each side wall surface segment being congruent with each other side wall surface segment and terminating at a common intersection point with an adjacent side wall surface segment on each of the two edges of the respective side wall surface segment; resonating the signal in the resonating cavity to generate the resonating signal; and passing the resonating signal from the housing.

11. The method of claim 10, wherein the base further comprises a signal ingress port configured to pass the signal into the resonating cavity, and a signal egress port configured to pass the resonating signal out of the resonating cavity.

12. The method of claim 10, further comprising:

shifting a resonant frequency of a low Q mode comprising a TM111 mode of the signal higher in frequency than a resonant frequency of a high Q mode comprising a TE011 mode of the signal.

13. The method of claim 10, wherein each of the two edges is located closer to a center of the resonating cavity than any other point on any of the plurality of side wall surface segments.

14. The method of claim 10, wherein the base forms a first plurality of openings, a side wall of the housing forms a second plurality of openings, and the cap forms a third plurality of openings, and the base, the side wall, and the housing are configured to be aligned such that the first plurality of openings, the second plurality of openings, and the third plurality of openings form a plurality of througholes that extend through the base, the housing, and the cap.

15. The method of claim 10, wherein the resonating cavity comprises four chambers.

16. The method of claim 10, wherein the resonating cavity comprises three chambers.

17. The method of claim 10, wherein the resonating cavity comprises five chambers.

18. The method of claim 10, wherein each side wall surface segment is cylindrical.

* * * * *